United States Patent [19]

Laureta

[11] 3,976,293

[45] Aug. 24, 1976

[54] BOWLING POCKET POOL GAME

[75] Inventor: Laurie Laureta, Oak Harbor, Wash.

[73] Assignee: The Raymond Lee Organization, Inc., New York, N.Y. ; a part interest

[22] Filed: Aug. 18, 1975

[21] Appl. No.: 605,221

[52] U.S. Cl. ..... 273/2; 36/81; 273/22; 273/123 R; 273/DIG. 18

[51] Int. Cl.[2] ..... A63B 67/00; A63B 71/12

[58] Field of Search ..... 273/2, 22, 41, 118 R, 273/123 R, DIG. 18; 36/1, 2.5 A, 81

[56] References Cited

UNITED STATES PATENTS

| | | | |
|---|---|---|---|
| 278,341 | 5/1883 | Kelly | 273/123 R |
| 1,679,659 | 8/1928 | Hasskarl et al. | 273/67 R UX |
| 2,223,384 | 12/1940 | Pecorella et al. | 36/81 |

FOREIGN PATENTS OR APPLICATIONS

| | | | |
|---|---|---|---|
| 488,390 | 6/1918 | France | 36/81 |

*Primary Examiner*—Anton O. Oechsle
*Attorney, Agent, or Firm*—Howard I. Podell

[57] ABSTRACT

A game of bowling in which the field of play is in the form of an oversize pocket pool table, with a cue ball and numbered target balls. The players wear shoes mounted on a high platform sole and heel and manually bowl the cue ball at the target ball to direct a specific target into one of the six corner or side pockets of the carpeted field of play.

3 Claims, 4 Drawing Figures

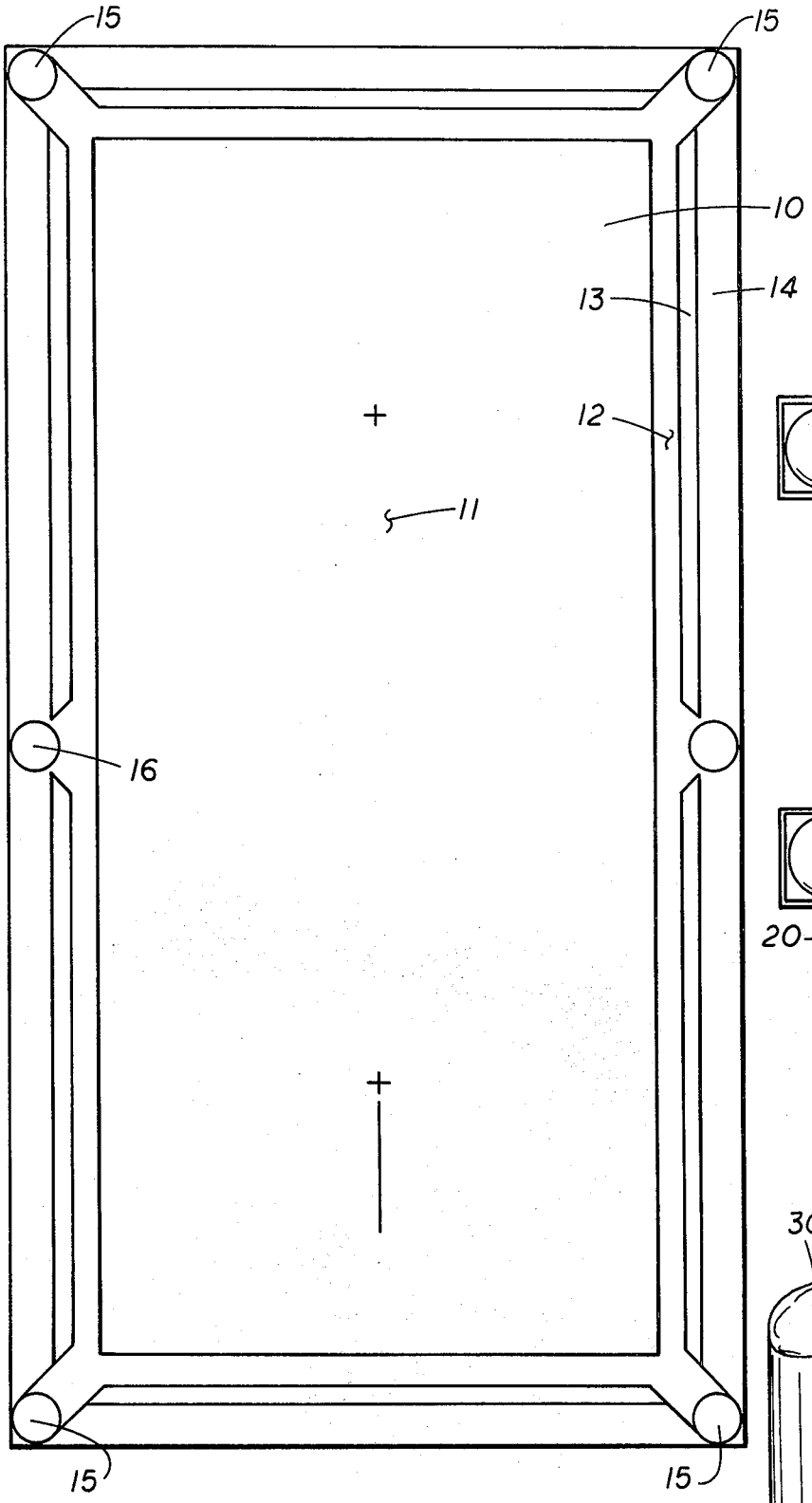
FIG. 1
FIG. 2
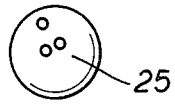
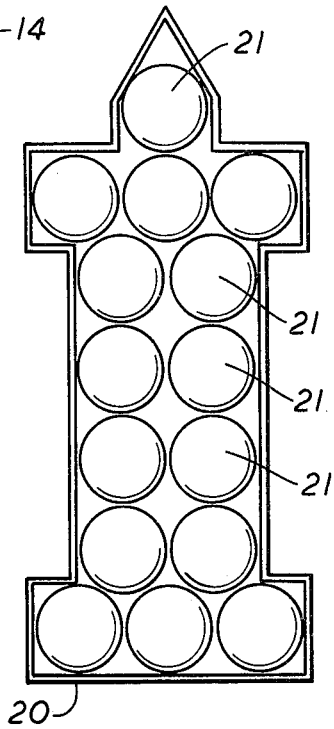
FIG. 3
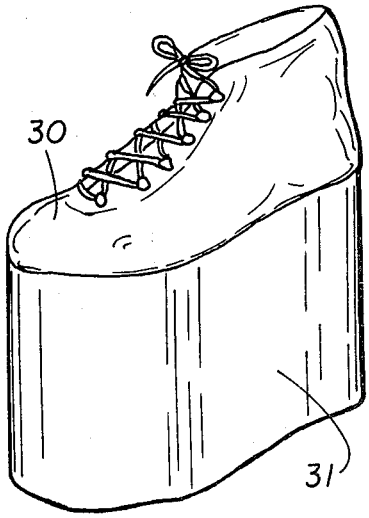
FIG. 4

BOWLING POCKET POOL GAME

SUMMARY OF THE INVENTION

My invention is a game of bowling in which the field of play is in the form of an oversize pocket pool table, with a cue ball and numbered target balls.

The players wear shoes mounted on a high platform sole and heel and manually bowl the cue ball at the target ball to direct a specific target into one of the six corner or side pockets of the carpeted field of play.

The field of play is a rectangular carpet of a uniform color, nounded by a border carpet of a contrasting color, about which are mounted rubber bumper rails backed by a wooden rail. Pockets are located in the four corners of the bumper and wooden rail and an additional pocket is located in each of two opposing side rails. Prior to bowling, the target balls are arrayed in a pattern by a modified I-shaped rack, pointed at one end.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a plan view of the playing field of the invention;

FIG. 2 is a perspective view of the cue bowling ball;

FIG. 3 is a plan view of the target balls arrayed in the start position by the rack; and FIG. 4 is a perspective view of a shoe worn by the players of the game.

DESCRIPTION OF THE PREFERRED EMBODIMENT

Turning now descriptively to the drawings, in which similar reference characters denote similar elements throughout the several views, FIG. 1 illustrates the playing field which is a colored carpeted floor 11 of rectangular shape surrounded by a border section 12 of a carpeted floor of a contrasting color to floor 11. Except for the four corner pockets 15 and the two side pockets 16, the border section 12 is surrounded by an upraised rubber rim 13 backed by an upraised wooden frame 14.

The pockets 15 and 16 are openings, at floor level, in the rim 13 and frame 14 of a size to each retain one target ball 21 that may be driven into a pocket. The dimensions of the playing field, bounded by the rim 13 are 16 by 34 feet in the preferred embodiment, which utilizes an 8½ inch diameter cue ball, 25, and 15 8-inch diameter individually marked or numbered target balls including the floating number eight ball. The cue ball 25, as shown in FIG. 2, is formed with three finger holes for grasping purposes.

At the outset of the game, the target balls are set in position by a wooden rack 20 which arranges the balls in a modified I shape headed by one target ball, to simulate a space craft.

The players walk on the playing field floor 11 but are only permitted to place one foot in the border section 12 when bowling the cue ball 25 at the 15 target balls 21 so as to attempt to direct specific target balls, in sequence, into a pocket 15 or 16.

For safety purposes, each player wears shoes 30, each fitted with a sole and heel platform 31 of a height of at least 5 inches, so that any ball rebounding from the rim 12 and striking a player's shoe will be deflected safely by the shoe platform 31.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A bowling game that simulates pocket pool comprising

- a playing field of rectangular shape formed with a carpeted floor surrounded by upraised rubber rims, with a pocket formed in each corner of the rim,
- a cue bowling ball fitted with finger holes, and a plurality of target bowling balls, together with
- a pair of playing shoes worn by each of the players who bowl the cue ball at the target balls, each of said playing shoes fitted with a heel and sole platform of a height which is greater than the radius of the cue ball or the target balls.

2. The combination as recited in claim 1 in which the carpeted floor is formed with a border of contrasting marking with the enclosed section of floor.

3. The combination as recited in claim 1 in which the dimensions of the playing field enclosed by the rubber rim are of the general size of 16 feet in width and 34 feet in length, with the cue ball being a sphere of 8½ inches diameter and the target balls being spheres of 8 inch diameter.

* * * * *